US007208429B2

(12) United States Patent
Vinson et al.

(10) Patent No.: US 7,208,429 B2
(45) **Date of Patent: *Apr. 24, 2007**

(54) FIBROUS STRUCTURES COMPRISING A NONOPARTICLE ADDITIVE

(75) Inventors: Kenneth Douglas Vinson, Cincinnati, OH (US); Michael Scott Prodoehl, West Chester, OH (US)

(73) Assignee: The Procter + Gamble Company, Cincinnati, OH (US)

( * ) Notice: Subject to any disclaimer, the term of this patent is extended or adjusted under 35 U.S.C. 154(b) by 35 days.

This patent is subject to a terminal disclaimer.

(21) Appl. No.: 11/001,891

(22) Filed: Dec. 2, 2004

(65) Prior Publication Data

US 2006/0121278 A1 Jun. 8, 2006

(51) Int. Cl.
*B32B 27/04* (2006.01)
*B32B 5/16* (2006.01)

(52) U.S. Cl. ..... 442/143; 442/417

(58) Field of Classification Search ..... 428/317.9, 428/311.71, 310.5, 311.51, 317.5; 604/374, 604/904, 369; 442/143, 417, 328
See application file for complete search history.

(56) References Cited

U.S. PATENT DOCUMENTS

| | | | | |
|---|---|---|---|---|
| 2,030,483 | A | 2/1936 | Uong | |
| 3,210,240 | A | 10/1965 | Read et al. | |
| 3,248,253 | A | 4/1966 | Barford et al. | |
| 3,461,032 | A | 8/1969 | Lichtenberger et al. | |
| 3,484,275 | A | 12/1969 | Lewicki | |
| 3,919,042 | A | 11/1975 | Spiller | |
| 4,556,560 | A | 12/1985 | Buckingham | |
| 5,611,890 | A | 3/1997 | Vinson et al. | |
| 5,622,599 | A | 4/1997 | Sproule et al. | |
| 5,672,249 | A | 9/1997 | Vinson et al. | |
| 5,700,352 | A | 12/1997 | Vinson et al. | |
| 5,759,346 | A | 6/1998 | Vinson | |
| 5,766,366 | A | 6/1998 | Ferguson et al. | |
| 5,830,317 | A | 11/1998 | Vinson et al. | |
| 5,866,286 | A | 2/1999 | Christy et al. | |
| 5,942,087 | A | 8/1999 | Pruszynski | |
| 5,958,185 | A | 9/1999 | Vinson et al. | |
| 5,985,030 | A | 11/1999 | Taylor et al. | |
| 5,988,001 | A | 11/1999 | Vucinovich | |
| 6,149,769 | A * | 11/2000 | Mohammadi et al. | 162/111 |
| 6,238,520 | B1 | 5/2001 | Greenwood | |
| 6,261,679 | B1 * | 7/2001 | Chen et al. | 428/317.9 |
| 6,355,330 | B1 | 3/2002 | Koslow et al. | |

(Continued)

FOREIGN PATENT DOCUMENTS

| | | |
|---|---|---|
| WO | WO 89/08741 A1 | 9/1989 |
| WO | WO 01/04417 | 1/2001 |
| WO | WO 03/076715 A2 | 9/2003 |

(Continued)

OTHER PUBLICATIONS

Research Disclosure "Powder impregnated tissue" Research Disclosure Database No. 363041; Research Disclosure Journal No. 36341; Published in Jul. 1994.

*Primary Examiner*—N. Edwards
(74) *Attorney, Agent, or Firm*—C. Brant Cook; Betty J. Zea; David M. Weirich

(57) ABSTRACT

Fibrous structures having an additive, more particularly finished fibrous structures having a nanoparticle solid additive, and/or sanitary tissue products including such finished fibrous structures, are provided.

20 Claims, 2 Drawing Sheets

U.S. PATENT DOCUMENTS

| | | | | |
|---|---|---|---|---|
| 6,417,425 | B1 | 7/2002 | Whitmore et al. | |
| 6,458,299 | B1 | 10/2002 | Wierer et al. | |
| 6,494,988 | B1 | 12/2002 | Cedra et al. | |
| 6,521,088 | B1 | 2/2003 | Richardson et al. | |
| 6,603,054 | B2 * | 8/2003 | Chen et al. | 604/369 |
| 6,720,024 | B2 | 4/2004 | Poliniak et al. | |
| 6,893,537 | B2 * | 5/2005 | Shannon et al. | 162/164.4 |
| 2003/0045847 | A1 | 3/2003 | Whitmore et al. | |
| 2004/0071758 | A1 | 4/2004 | Von Heimburg et al. | |

FOREIGN PATENT DOCUMENTS

| | | | |
|---|---|---|---|
| WO | WO 03/076716 | A3 | 9/2003 |
| WO | WO 03/076717 | A1 | 9/2003 |
| WO | WO 03/076718 | A2 | 9/2003 |
| WO | WO 03/076719 | A2 | 9/2003 |
| WO | WO 2004/044323 | A1 | 5/2004 |

* cited by examiner

FIBROUS STRUCTURES COMPRISING A NONOPARTICLE ADDITIVE

FIELD OF THE INVENTION

The present invention relates to fibrous structures comprising a nanoparticle additive. More particularly, the present invention relates to finished fibrous structures comprising a nanoparticle solid additive, and/or sanitary tissue products comprising such finished fibrous structures.

BACKGROUND OF THE INVENTION

Fibrous structures, especially low density, soft, linty finished fibrous structures and/or sanitary tissue products comprising such finished fibrous structures, for example toilet tissue and/or paper towels and/or facial tissue, comprising additives are well known in the art.

Traditionally, additives have been incorporated into fibrous structures by means of adding the additives to the fibrous slurry prior to forming the fibrous structures.

Other known methods of adding additives to fibrous structures include delivering the additives to the fibrous structures via liquid, especially aqueous, vehicles or carriers.

Alternatively, some additives have been delivered to fibrous structures in a contacting step, such as by printing the additives onto the fibrous structures via cylinders or rolls, such as rotogravure rolls, and/or by brushing the additives onto the fibrous structures and/or by transferring the additives from wires and or belts/fabrics during the papermaking process.

There exists problems, both product and process problems, with each of the prior art processes described above. In particular, the brushing process loosely associates its additive with the fibrous structure such that the average lint value for such fibrous structure is extremely high and not readily acceptable by consumers.

In addition, the additives added to prior art fibrous structures have been relatively large in average particle size.

Accordingly, there is a need for a fibrous structure, especially a finished fibrous structure and/or a sanitary tissue product comprising such a finished fibrous structure, such as toilet tissue and/or paper towel, wherein the fibrous structure comprises a fiber and a nanoparticle additive.

SUMMARY OF THE INVENTION

The present invention fulfills the needs described above by providing a fibrous structure comprising a nanoparticle additive.

In one example of the present invention, a finished fibrous structure comprising a nanoparticle solid additive is provided.

In another example of the present invention, a single- or multi-ply sanitary tissue product comprising a finished fibrous structure according to the present invention is provided.

Accordingly, the present invention provides fibrous structures, especially finished fibrous structures comprising a nanoparticle additive, and/or sanitary tissue products comprising such finished fibrous structures.

DETAILED DESCRIPTION OF THE INVENTION

Definitions

Figure 1:
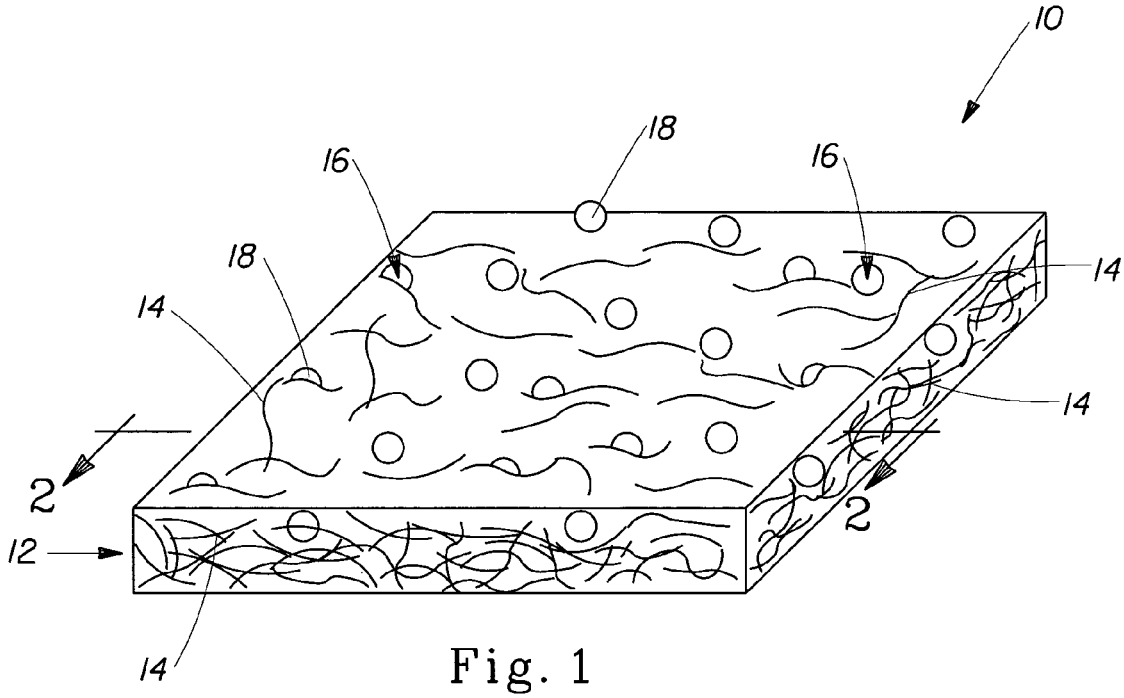
FIG. 1 is a schematic perspective representation of one example of a fibrous structure according to the present invention.

"Additive" as used herein means a material that is present in and/or on a fibrous structure at low levels. For example, an additive is a material that is present in and/or on a fibrous structure at levels less than 50% and/or less than 45% and/or less than 40% and/or less than 30% and/or less than 20% and/or less than 10% and/or less than 5% and/or less than 3% and/or less than 1% and/or less than 0.5% to about 0% by weight of the fibrous structure.

"Nanoparticle additive" as used herein means an additive that exhibits an average particle size of less than about 1 μm and/or less than about 0.9 μm (900 nm) and/or less than about 0.5 μm (500 nm) and/or less than about 0.4 μm (400 nm) and/or from about 1 μm to about 0.005 (5 nm) and/or from about 900 m to about 100 nm and/or from about 800 nm to about 200 nm.

"Solid additive" as used herein means an additive that is capable of being applied to a surface of a fibrous structure in a solid form. In other words, the solid additive of the present invention can be delivered directly to a surface of a fibrous structure without a liquid phase being present, i.e. without melting the solid additive and without suspending the solid additive in a liquid vehicle or carrier. As such, the solid additive of the present invention does not require a liquid state or a liquid vehicle or carrier in order to be delivered to a surface of a fibrous structure. The solid additive or the present invention may be delivered via a gas or combinations of gases. For purposes of the present invention, delivery of an additive, liquid and/or solid, into a slurry of fibers used to produce a fibrous structure is not encompassed by this phrase. However, such an additive may be present in a finished fibrous structure so long as the finished fibrous structure also comprises a solid additive as defined herein. Further, an additive, liquid and/or solid, delivered to a fibrous structure via a liquid vehicle, such as a latex emulsion, may be present in a finished fibrous structure so long as the finished fibrous structure also comprises a solid additive as defined herein. Further, an additive, liquid and/or solid, delivered to a fibrous structure via melting, such as a hot melt adhesive, may be present in a finished fibrous structure so long as the finished fibrous structure also comprises a solid additive as defined herein. In simplistic terms, a solid additive is an additive that when placed within a container, does not take the shape of the container.

"Density" or "Apparent density" as used herein means the mass per unit volume of a material. For fibrous structures, the density or apparent density can be calculated by dividing the basis weight of a fibrous structure sample by the caliper of the fibrous structure sample with appropriate conversions incorporated therein. Density and/or apparent density used herein has the units g/cm$^3$. The density of a material, such as a solid additive in accordance with the present invention is determined according to the Density Test Method described herein. Again, the units for density of a material as used herein are g/cm$^3$.

"Average particle size" or "Particle Size Mean" as used herein for a material, such as a solid additive in accordance with the present invention, is determined according to the Average Particle Size Test Method described herein. The units for average particle size as used herein are μm.

"Sphericity", symbolized "$\Phi_s$", is a term which used herein relates to the shape of a solid additive. Sphericity is defined as:

$$\Phi_s = \frac{6\upsilon_p}{D_p S_p}$$

wherein: $D_p$ is equivalent spherical diameter of a solid additive, $S_p$ is the surface area of the solid additive, and $\upsilon_p$ is the volume of the solid additive. The equivalent spherical diameter is defined as the diameter of a sphere having the same volume as the solid additive. $D_p$ is closely approximated by the nominal size based on screen analysis or microscopic analysis. Those skilled in the art will recognize that surface area can readily be determined by adsorption measurements or from the pressure drop in a bed of solid additives. Sphericity varies between 0 and 1. A perfectly spherical solid additive exhibits a sphericity of 1; deviations from perfect sphere, for example platy materials such as mica, clay, or talc, possess much lower sphericity.

"Fiber" as used herein means an elongate particulate having an apparent length greatly exceeding its apparent diameter, i.e. a length to diameter ratio of at least about 10. A fiber can be a solid additive. Fibers having a non-circular cross-section are common; the "diameter" in this case may be considered to be the diameter of a circle having cross-sectional area equal to the cross-sectional area of the fiber. More specifically, as used herein, "fiber" refers to papermaking fibers. The present invention contemplates the use of a variety of papermaking fibers, such as, for example, natural fibers or synthetic fibers, or any other suitable fibers, and any combination thereof.

Natural papermaking fibers useful in the present invention include animal fibers, mineral fibers, plant fibers and mixtures thereof. Animal fibers may, for example, be selected from the group consisting of: wool, silk and mixtures thereof. Plant fibers may, for example, be derived from a plant selected from the group consisting of: wood, cotton, cotton linters, flax, sisal, abaca, hemp, hesperaloe, jute, bamboo, bagasse, kudzu, corn, sorghum, gourd, agave, loofah and mixtures thereof.

Wood fibers; often referred to as wood pulps include chemical pulps, such as kraft (sulfate) and sulfite pulps, as well as mechanical and semi-chemical pulps including, for example, groundwood, thermomechanical pulp, chemi-mechanical pulp (CMP), chemi-thermomechanical pulp (CTMP), neutral semi-chemical sulfite pulp (NSCS). Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified and/or layered web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

The wood pulp fibers may be short (typical of hardwood fibers) or long (typical of softwood fibers). Nonlimiting examples of short fibers include fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia. Nonlimiting examples of long fibers include fibers derived from Pine, Spruce, Fir, Tamarack, Hemlock, Cypress, and Cedar. Softwood fibers derived from the kraft process and originating from more-northern climates may be preferred. These are often referred to as northern softwood kraft (NSK) pulps.

Synthetic fibers may be selected from the group consisting of: wet spun fibers, dry spun fibers, melt spun (including melt blown) fibers, synthetic pulp fibers and mixtures thereof. Synthetic fibers may, for example, be comprised of cellulose (often referred to as "rayon"); cellulose derivatives such as esters, ether, or nitrous derivatives; polyolefins (including polyethylene and polypropylene); polyesters (including polyethylene terephthalate); polyamides (often referred to as "nylon"); acrylics; non-cellulosic polymeric carbohydrates (such as starch, chitin and chitin derivatives such as chitosan); and mixtures thereof.

"Fiber Length", "Average Fiber Length" and "Weighted Average Fiber Length", are terms used interchangeably herein all intended to represent the "Length Weighted Average Fiber Length" as determined for example by means of a Kajaani FiberLab Fiber Analyzer commercially available from Metso Automation, Kajaani Finland. The instructions supplied with the unit detail the formula used to arrive at this average. The recommended method for measuring fiber length using this instrument is essentially the same as detailed by the manufacturer of the FiberLab in its operation manual. The recommended consistencies for charging to the FiberLab are somewhat lower than recommended by the manufacturer since this gives more reliable operation. Short fiber furnishes, as defined herein, should be diluted to 0.02–0.04% prior to charging to the instrument. Long fiber furnishes, as defined herein, should be diluted to 0.15%–0.30%. Alternatively, fiber length may be determined by sending the short fibers to a contract lab, such as Integrated Paper Services, Appleton, Wis.

Nonlimiting examples of suitable fibers used in the present invention include fibers that exhibit an average fiber length of less than about 5 mm and/or less than about 3 mm and/or less than about 1.2 mm and/or less than about 1.0 mm and/or from about 0.4 mm to about 5 mm and/or from about 0.5 mm to about 3 mm and/or from about 0.5 mm to about 1.2 mm and/or from about 0.6 mm to about 1.0 mm.

"Fibrous structure" as used herein means a structure that comprises one or more fibers. Nonlimiting examples of processes for making fibrous structures include known wet-laid papermaking processes and air-laid papermaking processes. Such processes typically include steps of preparing a fiber composition, oftentimes referred to as a fiber slurry in wet-laid processes, either wet or dry, and then depositing a plurality of fibers onto a forming wire or belt such that an embryonic fibrous structure is formed, drying and/or bonding the fibers together such that a fibrous structure is formed, and/or further processing the fibrous structure such that a finished fibrous structure is formed. For example, in typical papermaking processes, the finished fibrous structure is the fibrous structure that is wound on the reel at the end of papermaking, but before converting thereof into a sanitary tissue product. Those of skill in the art will appreciate that fine paper, such as writing paper and/or other paper that is not typically suited for use in sanitary tissue products, may be excluded from the scope of the present invention, especially since the typical lint values for such "fine" paper is less than 1. In one example, the fibrous structure is a wet-laid fibrous structure.

"Sanitary tissue product" comprises one or more finished fibrous structures, converted or not, that is useful as a wiping implement for post-urinary and post-bowel movement cleaning (toilet tissue), for otorhinolaryngological discharges (facial tissue), and multi-functional absorbent and cleaning uses (absorbent towels).

"Basis Weight" as used herein is the weight per unit area of a sample reported in lbs/3000 $ft^2$ or $g/m^2$. Basis weight is measured by preparing one or more samples of a certain area ($m^2$) and weighing the sample(s) of a fibrous structure according to the present invention and/or a sanitary tissue product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$) is measured. The basis weight ($g/m^2$) is calculated by dividing the average weight (g) by the average area of the samples ($m^2$).

"Machine Direction" or "MD" as used herein means the direction parallel to the flow of the fibrous structure through the papermaking machine and/or product manufacturing equipment.

"Cross Machine Direction" or "CD" as used herein means the direction perpendicular to the machine direction in the same plane of the fibrous structure and/or sanitary tissue product comprising the fibrous structure.

"Dry Tensile Strength" (or simply "Tensile Strength" as used herein) of a fibrous structure and/or sanitary tissue product is measured as follows. One (1) inch by five (5) inch (2.5 cm×12.7 cm) strips of fibrous structure and/or sanitary tissue product are provided. The strip is placed on an electronic tensile tester Model 1122 commercially available from Instron Corp., Canton, Mass. in a conditioned room at a temperature of 73° F.±4° F. (about 28° C.±2.2° C.) and a relative humidity of 50%±10%. The crosshead speed of the tensile tester is 2.0 inches per minute (about 5.1 cm/minute) and the gauge length is 4.0 inches (about 10.2 cm). The Dry Tensile Strength can be measured in any direction by this method. The "Total Dry Tensile Strength" or "TDT" is the special case determined by the arithmetic total of MD and CD tensile strengths of the strips.

"Peak Load Stretch" (or simply "Stretch") as used herein is determined by the following formula:

$$\frac{\text{Length of Fibrous } Structure_{PL} - \text{Length of Fibrous } Structure_I}{\text{Length of Fibrous } Structure_I} \times 100$$

wherein:

Length of Fibrous $Structure_{PL}$ is the length of the fibrous structure at peak load;

Length of Fibrous $Structure_I$ is the initial length of the fibrous structure prior to stretching;

The Length of Fibrous $Structure_{PL}$ and Length of Fibrous $Structure_I$ are observed while conducting a tensile measurement as specified in the above. The tensile tester calculates the stretch at Peak Load. Basically, the tensile tester calculates the stretches via the formula above.

"Caliper" as used herein means the macroscopic thickness of a sample. Caliper of a sample of fibrous structure according to the present invention is determined by cutting a sample of the fibrous structure such that it is larger in size than a load foot loading surface where the load foot loading surface has a circular surface area of about 3.14 $in^2$ (20.3 $cm^2$). The sample is confined between a horizontal flat surface and the load foot loading surface. The load foot loading surface applies a confining pressure to the sample of 15.5 $g/cm^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in millimeters.

"Surface of a finished fibrous structure" as used herein means that portion of the finished fibrous structure that is exposed to the external environment. In other words, the surface of a finished fibrous structure is that portion of the finished fibrous structure that is not completely surrounded by other portions of the finished fibrous structure.

"Ply" or "Plies" as used herein means an individual finished fibrous structure optionally to be disposed in a substantially contiguous, face-to-face relationship with other plies, forming a multiple ply finished fibrous structure product and/or sanitary tissue product. It is also contemplated that a single fibrous structure can effectively form two "plies" or multiple "plies", for example, by being folded on itself.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Finished Fibrous Structures Comprising a Solid Additive

As shown in FIG. 1, in one example of the present invention, a finished fibrous structure 10 comprises a fiber component 12 comprising a fiber 14 and an additive component 16 comprising a solid additive 18. The solid additive 18 may be bound, physically and/or chemically, to one or more fibers 14.

Figure 2:
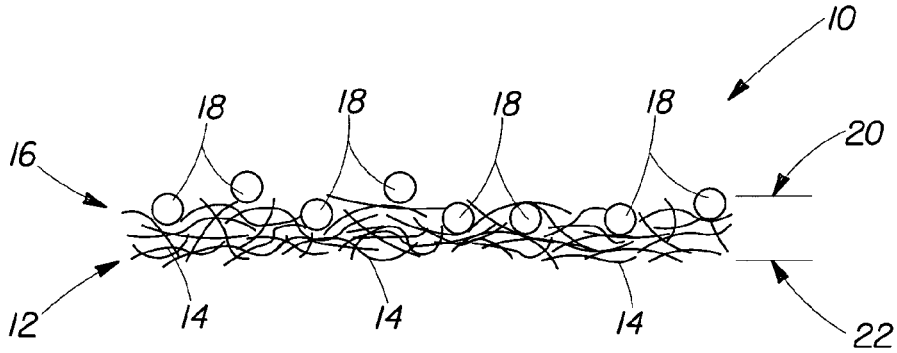
FIG. 2 is a cross-sectional view of the fibrous structure of FIG. 1 taken along line 2—2.

The finished fibrous structure 10 may comprise a first surface 20 and a second surface 22 opposite from the first surface 20 as shown in FIG. 2. The solid additive 18 may be present on a surface of the finished fibrous structure, such as the first surface 20, at a greater level by weight than within the finished fibrous structure 10 as determined by the Determination of Surface Concentration of Solid Additive Test Method.

For explanation and/or clarity purposes, the solid additives 18 are shown in a dispersed nature, however, the concentration of the solid additives 18 on the first surface 20 of the finished fibrous structure 10 and/or the second surface 22 of the finished fibrous structure 10 may be such that the entire surface area or almost the entire surface area of the first surface 20 and/or the second surface 22 may be in contact with the solid additives 18.

Figure 3:
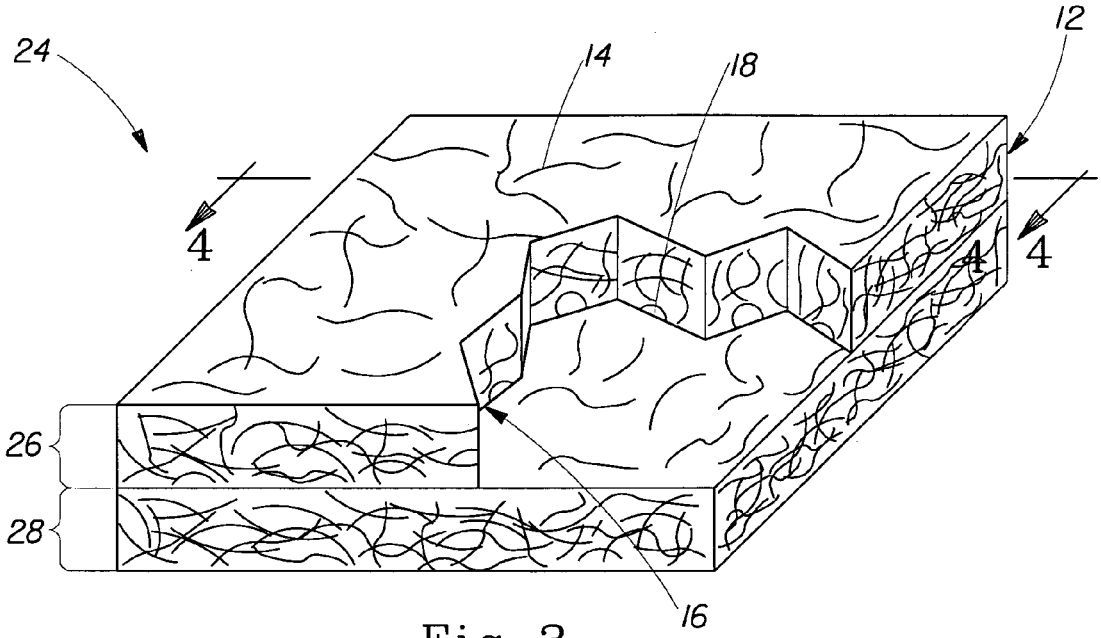
FIG. 3 is a schematic perspective representation of one of example of a multi-ply sanitary tissue product according to the present invention with a partial cut-away to expose the interface between the plies of the multi-ply sanitary tissue product.
Figure 4:
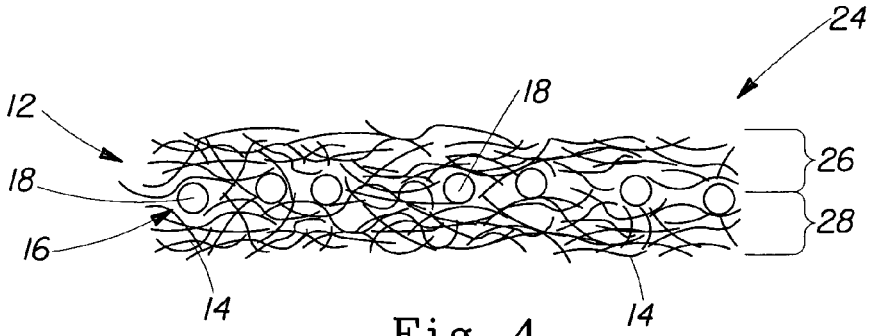
FIG. 4 is a cross-sectional view of the multi-ply sanitary tissue product of FIG. 3 taken along line 4—4.
Figure 5:
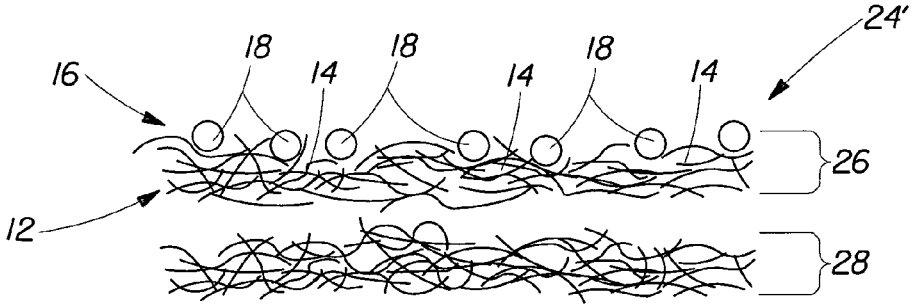
FIG. 5 is an alternate example of the cross-sectional view of FIG. 4.

As shown in FIG. 3, in one example of the present invention, a multi-ply sanitary tissue product 24 comprises a first ply of a finished fibrous structure 26 and a second ply of a finished fibrous structure 28. The first ply 26 comprises a finished fibrous structure in accordance with the present invention, such as is shown and described in FIGS. 1 and 2. A surface of the first ply 26 comprising the solid additive 18 can form an interior surface of the multi-ply sanitary tissue product 24, as shown in FIGS. 3 and 4, or an exterior surface of the multi-ply sanitary tissue product 24', as shown in FIG. 5. In one example, the second ply of a finished fibrous structure 28 may comprise a finished fibrous structure in accordance with the present invention. It's orientation within the multi-ply sanitary tissue product 24 may be similar or different from that of the first ply 26. Even though FIGS. 3–5 illustrate only a two-ply multi-ply sanitary tissue product, one skilled in the art will appreciate that three-ply and other multi-ply sanitary tissue products are encompassed by the present invention.

The solid additive may be present on a surface of a finished fibrous structure in a random or uniform pattern. One solid additive may be present on a surface of a finished fibrous structure in a random pattern and a different solid additive may be present on the surface in a uniform pattern.

Nonlimiting types of finished fibrous structures according to the present invention include conventionally felt-pressed fibrous structures; pattern densified fibrous structures; and high-bulk, uncompacted fibrous structures. The fibrous structures may be of a homogenous or multilayered (two or three or more layers) construction; and the sanitary tissue products made therefrom may be of a single-ply or multi-ply construction.

The finished fibrous structures and/or sanitary tissue products of the present invention may exhibit a basis weight of between about 10 $g/m^2$ to about 120 $g/m^2$ and/or from about 14 $g/m^2$ to about 80 $g/m^2$ and/or from about 20 $g/m^2$ to about 60 $g/m^2$.

The finished fibrous structures and/or sanitary tissue products of the present invention may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in).

The finished fibrous structure and/or sanitary tissue products of the present invention may exhibit a density of less than about 0.60 $g/cm^3$ and/or less than about 0.30 $g/cm^3$ and/or less than about 0.20 $g/cm^3$ and/or less than about 0.10 $g/cm^3$ and/or less than about 0.07 $g/cm^3$ and/or less than about 0.05 $g/cm^3$ and/or from about 0.01 $g/cm^3$ to about 0.20 $g/cm^3$ and/or from about 0.02 $g/cm^3$ to about 0.10 $g/cm^3$.

The finished fibrous structures and/or sanitary tissue products of the present invention may exhibit a stretch at peak load of at least about 10% and/or at least about 15% and/or at least about 20% and/or from about 10% to about 70% and/or from about 10% to about 50% and/or from about 15% to about 40% and/or from about 20% to about 40%.

The solid additives present on the finished fibrous structures of the present invention and/or sanitary tissue products comprising such finished fibrous structures may be associated with the finished fibrous structures such that little or no solid additives become disassociated from the finished fibrous structures as dust.

In one example, the finished fibrous structure of the present invention is a pattern densified fibrous structure characterized by having a relatively high-bulk region of relatively low fiber density and an array of densified regions of relatively high fiber density. The high-bulk field is characterized as a field of pillow regions. The densified zones are referred to as knuckle regions. The knuckle regions exhibit greater density than the pillow regions. The densified zones may be discretely spaced within the high-bulk field or may be interconnected, either fully or partially, within the high-bulk field. Typically, from about 8% to about 65% of the fibrous structure surface comprises densified knuckles, the knuckles may exhibit a relative density of at least 125% of the density of the high-bulk field. Processes for making pattern densified fibrous structures are well known in the art as exemplified in U.S. Pat. Nos. 3,301,746, 3,974,025, 4,191,609 and 4,637,859.

The finished fibrous structure may exhibit regions of higher density compared to other regions within the finished fibrous structure and a solid additive may be present in the regions of higher density at a weight level greater than the weight % level of the solid additive in the other regions of the finished fibrous structure. For example, the solid additive may be present on the knuckle regions of a finished fibrous structure at a different weight % level than on the pillow regions of the finished fibrous structure.

Solid Additive

Nonlimiting examples of suitable nanoparticle solid additives may be selected from the group consisting of: fillers, inks, dyes, medicines, opacifiers, abrasives, adhesives, wet strengthening additives, dry strengthening additives, odor control aids (such as activated carbon and/or charcoal and/or zeolites), absorbency aids, lotions, softeners, low surface energy particles, surface friction modifying agents, antivirucidal agents, perfume agents, skin care agents, carbohydrate polymers, antibacterial agents, hydrophobic polymers and mixtures thereof.

In one example, the solid additive is a hygro-activated material. In other words, the solid additive changes its chemical and/or physical properties upon being exposed to a certain level of a liquid, such as water.

In another example, the solid additive is a thermally-activated material. In other words, the solid additive changes its chemical and/or physical properties upon being exposed to a certain temperature.

Nonlimiting examples of fillers include clays and/or talc. Nonlimiting examples of suitable clays include kaolin clays, bentonite clays (e.g., laponite clays commercially available from Southern Clay) and mixtures thereof. The clays may be modified, such as chemically modified and/or physically modified, or they may be unmodified.

Nonlimiting examples of opacifiers include titanium dioxide.

Nonlimiting examples of adhesives, which also may function as dry and/or wet strength agents, include thermoplastic polymers, nonlimiting examples of which include polyolefins, polyesters, polyamides, polyurethanes and mixtures thereof and/or thermosetting polymers, nonlimiting examples of which include polyesters, polyurethanes, epoxy and mixtures thereof.

Nonlimiting examples of absorbency aids include superabsorbent materials, nonlimiting examples of which include cross-linked cellulose ethers, polyacrylates and mixtures thereof.

Nonlimiting examples of low surface energy particles include fluorocarbon polymer particles, silicone polymer particles and mixtures thereof. In one example, the fluorocarbon polymer particle comprises polytetrafluoroethylene (PTFE). In one example, the silicone polymer particle comprises polydimethyl siloxane.

Nonlimiting examples of hydrophobic polymers include anionic, cationic, nonionic and amphoteric polyurethanes, polyurethane-acrylics, polyurethane-polyvinylpyrrolidones, polyesters, polyester-polyurethanes, polyesteramides, fatty-chain polyesters wherein the fatty-chain comprises at least twelve (12) carbon atoms, polyamide resins, ethylene-glycol adipates, polyethylene glycol adipates, random copolymer reaction products of alkylene oxide and alcohol, polytriethylene glycols, polyethylene glycols and mixtures thereof.

Nonlimiting examples of carbohydrate polymers include starch, starch derivatives, cellulose, cellulose derivatives, guar, xanthan, arabinogalactan, carrageen, chitin, chitin derivatives, chitosan, chitosan derivatives and mixtures thereof.

In one example, the density of the solid additive may be less than about 7 g/cm$^3$ and/or less than about 5 g/cm$^3$ and/or less than about 4 g/cm$^3$ and/or less than about 3 g/cm$^3$ and/or less than about 2 g/cm$^3$ and/or less than about 1 g/cm$^3$ to about 0.001 g/cm$^3$ and/or to about 0.01 g/cm$^3$ and/or to about 0.1 g/cm$^3$ and/or to about 0.5 g/cm$^3$.

In one example, the solid additive exhibits a sphericity of less than 1 and/or less than about 0.8 and/or less than about 0.6 and/or less than about 0.5 and/or less than about 0.3.

The finished fibrous structure may comprise two or more different solid additives. Such different solid additives may differ from each other by chemical composition, aspect ratio, average particle size, sphericity and/or density. At least one of the solid additives may function as a fluidizing agent to facilitate the fluidization to enhance delivery to the surface of the fibrous structure of at least one of the other solid additives.

The finished fibrous structure may comprise a solid additive and a fluidizing agent, wherein the fluidizing agent exhibits a density that is greater than the density of the solid additive excluding the fluidizing agent.

The finished fibrous structure may comprise a solid additive and a fluidizing agent, wherein the fluidizing agent exhibits an average particle size that is less than the average particle size of the solid additive excluding the fluidizing agent.

The finished fibrous structure may comprise a solid additive and a fluidizing agent, wherein the fluidizing agent exhibits a sphericity less than the sphericity of the solid additive excluding the fluidizing agent.

In one example, the solid additive comprises a carbohydrate polymer, such as a solid additive starch, and an inorganic mineral, for example kaolin clay. Generally, clay, such as kaolin clay, exhibit a smaller average particle size; greater density; and, a lower sphericity than carbohydrate polymers.

Non-Solid Additives

In addition to the solid additives, the finished fibrous structures of the present invention may comprise suitable non-solid additives as are known in the art.

Synthesis Example for Making a Finished Fibrous Structure

The following Example illustrates preparation of sanitary tissue product comprising a finished fibrous structure according to the present invention on a pilot-scale Fourdrinier fibrous structure making machine.

An aqueous slurry of NSK of about 3% consistency is made up using a conventional repulper and is passed through a stock pipe toward the headbox of the Fourdrinier.

In order to impart temporary wet strength to the finished fibrous structure, a 1% dispersion of temporary wet strengthening additive (e.g., Parez®) is prepared and is added to the NSK stock pipe at a rate sufficient to deliver 0.3% temporary wet strengthening additive based on the dry weight of the NSK fibers. The absorption of the temporary wet strengthening additive is enhanced by passing the treated slurry through an in-line mixer.

An aqueous slurry of eucalyptus fibers of about 3% by weight is made up using a conventional repulper.

The NSK fibers are diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are both directed to a layered headbox capable of maintaining the slurries as separate streams until they are deposited onto a forming fabric on the Fourdrinier.

The fibrous structure making machine has a layered headbox having a top chamber, a center chamber, and a bottom chamber. The eucalyptus fiber slurry is pumped through the top and bottom headbox chambers and, simultaneously, the NSK fiber slurry is pumped through the center headbox chamber and delivered in superposed relation onto the Fourdrinier wire to form thereon a three-layer embryonic web, of which about 70% is made up of the eucalyptus fibers and 30% is made up of the NSK fibers. This combination results in an average fiber length of about 1.6 mm. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The speed of the Fourdrinier wire is about 750 fpm (feet per minute).

The embryonic wet web is transferred from the Fourdrinier wire, at a fiber consistency of about 15% at the point of transfer, to a patterned drying fabric. The speed of the patterned drying fabric is the same as the speed of the Fourdrinier wire. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 12 mils above the supporting fabric. A suitable process for making the patterned drying fabric is described in published application US 2004/0084167 A1.

Further de-watering is accomplished by vacuum assisted drainage until the web has a fiber consistency of about 30%.

While remaining in contact with the patterned drying fabric, the web is pre-dried by air blow-through pre-dryers to a fiber consistency of about 65% by weight.

After the web exits the blow-through pre-dryers, solid additive is applied using a VersaSpray 2 electrostatic applicator and SureCoat controller from the Nordson Corporation of Amherst, Ohio. The solid additive in this example is a blend of 85% corn starch and 15% kaolin. The corn starch is trade named International PFP from Pocahontas Food Products of Richmond Va. The kaolin is trade named WP Dry from Imerys of Roswell, Ga. The starch and kaolin are thoroughly mixed and then placed in a model HR-8–80 hopper from Nordson Corporation. A minimum amount of air pressure (from ½ to 20 psi) is used to fluidize the solid additive in the hopper.

Settings of 95 kV and 50 μA are entered into the SureCoat controller to set up a negative corona charge at the tip of the VersaSpray 2 electrostatic applicator. A venturi pump with orifice diameter of 5 mm transports solid additive from the hopper to the web. Flow Rate air pressure of 20 psi and Atomizing air pressure of 15 psi provide about 175 g/min of solid additive out of each venturi pump. Fan spray nozzles with a 2.5 mm×13 mm opening are used to direct the solid additive flow to the web. The nozzles are placed 3" from the web, orthogonal to the plane of the web, and aimed at the trailing edge of a ⅝" rectangular slot in a vacuum box placed behind the patterned drying fabric. The flat spray of solid additive is aligned parallel to the web's cross direction. A vacuum of 10 inches of Hg is applied to the vacuum box. The vacuum captures the majority of solid additive that does not remain with the web. At a 50% first pass retention, about 4 $g/m^2$ of solid additive is applied to the 21 $g/m^2$ of fiber.

The semi-dry web is then transferred to the Yankee dryer and adhered to the surface of the Yankee dryer with a sprayed creping adhesive. The creping adhesive is an aqueous dispersion with the actives consisting of about 22% polyvinyl alcohol, about 11% CREPETROL A3025, and about 67% CREPETROL R6390. CREPETROL A3025 and CREPETROL R6390 are commercially available from Hercules Incorporated of Wilmington, Del. The creping adhesive is delivered to the Yankee surface at a rate of about 0.15% adhesive solids based on the dry weight of the web. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm. The finished fibrous structure is wound in a roll using a surface driven reel drum having a surface speed of about 656 feet per minute. The finished fibrous structure may be subsequently converted into a two-ply sanitary tissue product having a basis weight of about 50 g/m2 in one case with solid additive coated surface directed outwards and in a second case with solid additive coated surface directed inwards. The average lint value of the sanitary tissue product made by converting with the solid additive on the outside surface is about 3. The lint value of a sanitary tissue product made by converting with the solid additive on the inside is about 6. A similarly made sanitary tissue product, omitting the solid additive step and equalizing basis weight by increasing the weight of the NSK and eucalyptus proportionally, has a lint value of about 7.

Test Methods

Determination of Surface Concentration of Solid Additive Test Method

Any method which quantitatively compares the surface concentration of the solid additive to the concentration beneath that surface is satisfactory for determining whether a fibrous structure meets the requirements of the present invention. The ideal method examines a relatively thin depth of the fibrous structure corresponding to the target surface and compares the concentration of solid additive found in that depth to the concentration found in the fibrous structure in an equivalent depth lying just below this surface depth.

Two problems arise in implementing this ideal. The first is that quantitative analysis of concentration requires determining a ratio of solid additive to total material. As the section defining the surface approaches zero depth, the fraction approaches the indeterminate form 0/0.

The second issue is that it is recognized that fibrous structures do not have a smooth surface. The surface is a fractal geometry meaning that the contour following the surface becomes more and more intricate as the observer uses a smaller and smaller scale to examine it.

The following definition and example method address these issues.

For the purposes of the present invention a part of the fibrous structure can be regarded as residing on the surface of that structure if the structure contains a plane parallel to the center of the structure and containing the point in question sections the fibrous structure into two parts such that the mass in the part of the outward from the plane toward the target side is relatively small compared to the amount of mass inward toward the center of the structure.

For fibrous structures of homogeneous fiber content, inventors have found it suitable if such a plane divides the structure into a surface plane have a percentage of mass of at least about 2.5% and at most about 6.25% and a bulk plane have a percentage of mass of at least about 93.75% and at most about 97.5%.

An example testing method is a tape method of extracting layers of fibers and solid additive from a fibrous structure in order to identify the stratification of the solid additive. To implement the method, a fibrous structure, typically a sheet of paper, towel or tissue is selected which is clean and free of folds, wrinkles and blemishes.

The target side, opposite side and the machine direction of the sheet are determined. The target side comprises the surface of interest with respect to potentially carrying the solid additive within the bounds of the present invention. The opposite side may also contain solid additive or not.

The sample size should be approximately 27.9 centimeters (11 inches) to 35.56 centimeters (14 inches) in the cross machine direction for the length and 5.08 centimeters (2 inches) to 15.24 centimeters (6 inches) in the machine direction of the width.

The sample of the fibrous structure is placed on a flat surface with the target side up. Thereafter, a strip of tape of approximately 2.5 centimeters (1 inch) in width is removed from a roll of tape. Typically, a transparent tape such as Scotch® brand adhesive tape is used. In the event the adhesive of this tape interferes with the subsequent analysis, any tape of similar adhesion characteristics can be substituted.

The tape strip should be approximately 10.16 centimeters (4 inches) longer than the sample. Static is removed from the tape by wiping the smooth surface of the tape onto or with a soft, damp surface or air stream. The static-free sticky-side of the tape is applied to the top surface of the sample to be tested. The tape is centered in the long direction of the sample and lowered onto the sheet from one end to the other in a gentle touch-down manner. Air pockets are avoided. The tape is not pressed or touched on the surface. This tape is labeled "TARGET" side.

Thereafter, the sample together with the tape is turned upside down. The tail ends of the tape are taped to the flat surface. A second strip of tape is applied to the opposite side of the taped specimen directly above the first strip of tape. This tape is labeled "OPPOSITE" side.

Thereafter, a paper cutter is utilized to trim 0.317 centimeters (⅛ inch) off each edge of the sample. A 2000 gram weight is rolled across the length of the tape specimen on the target surface and opposite surface, once on each side. Pressure is not exerted on the weight. The weight is moved at a uniform slow speed over the surface of the sample.

Subsequently, the two tapes are pulled apart at approximately a 180° angle at a uniform moderate speed. The tapes are not jerked or yanked.

The tape labeled "OPPOSITE" side may be discarded.

The fiber tape split labeled "TARGET" side is positioned on a flat surface with the fiber surface up. The tail ends are taped down. A 2.54 centimeter (1 inch) strip of tape is applied as previously done. The steps identified hereinabove are followed to split the ½ sheet fiber into two ¼ sections. Again, the tape labeled "TARGET" is retained and the other tape may be discarded. Another split is done to divide the ¼ specimen into ⅛ splits. Finally, another split is done to divide the ⅛ specimen into 1/16 splits sectioning the fibrous structure into layers of fiber (and potentially solid additive) attached to tapes. The splits are then identified in sequence starting from the target side of the sample, i.e. the initial tape is labeled #1. The 1/16 split taken immediately adjacent to #1 is labeled #2. Tape #1 contains the surface of the original fibrous structure specimen. Tape #2 is the reference section of the structure.

Briefly, if the concentration solid additive on Tape #1 is greater than Tape #2 then the fibrous structure is said to have its highest concentration of solid additive on the surface. Concentration in this case is defined as the weight of solid additive divided by the total weight of the section of interest of the fibrous structure.

Given the wide variety of solid additives and fiber components embodied in the present invention, it is not possible to specify a single quantitative analysis technique for determining the weight of solid additive which covers all of them. Those skilled in the art of analytical chemistry will recognize that it is possible to use conventional wet chemistry analytical methods, or instrumental analysis such as NMR or XRF, for example. It is also possible to use image analysis if the particle counts and sizes can be easily converted to weights. Caution must be used in all cases to avoid interference of the components of the fibrous structure or the tape with solid additive determination. This might limit the type of tape that can be used if such an interference is found or perhaps a combination of methods would be indicated.

Density Test Method

Density of the solid additive(s) is measured using a Micromeritics' AccuPyc 1330 Pycnometer, which is commercially available from Micromeritics Instrument Company of Norcross, Ga.

A suitable sample cup is weighed. Fill ⅔ of the sample cup volume with the solid additive sample to be tested. Wipe the outside and the inner edge of the sample cup clean of any solid additive residue. Weigh the sample cup with the solid additive sample and note this weight. Quickly remove the cell chamber cap on the AccuPyc, place the sample cup inside it and replace the chamber cap to a finger tight position. Set the AccuPyc such that the AccuPyc operates as follows: purge 10 times with research grade helium at a purge fill pressure of 19.5 psig. Conduct a total of 10 runs, with a run fill pressure of 19.5 psig at an equilibration rate of 0.005 psig/min and under a no use run precision condition. Start the analysis by entering the sample ID and sample weight into the AccuPyc. The resulting density of the solid additive sample is reported as an average of 10 runs and is expressed as $g/cm^3$.

Average Particle Size Test Method

Average particle size of the solid additive(s) is measured using a Horiba LA-910 commercially available from Horiba International Corporation of Irvine, Calif.

One skilled in the art knows that the suitable and appropriate operating conditions for the Horiba LA-910 can be found by running one or more pilot runs on the Horiba LA-910 for the solid additive sample. Visually, one skilled in the art can determine whether the solid additive sample is bimodal or unimodal regarding particle size. If the solid additive sample contains agglomerates, then one of skill in the art will utilize ultrasonics to break up the agglomerates before running the average particle size test. During the pilot run(s), whether the solid additive sample is bimodal or unimodal can be determined. During the pilot runs, one skilled in the art can determine the appropriate agitation and circulation speed, and if the average particle size from the sample is less than 10 μm, can obtain the relative refactive index from Horiba's database.

Follow the Horiba LA-910 Instrument manual to for setup and software use instructions. Obtain the relative refractive index for the solid additive sample to be tested from the Horiba refractive index database.

Input the appropriate measurement conditions into the instrument: Agitation and Circulation Speed—obtained from pilot run(s); Sampling Times 25; Standard Distribution; Dispersant Tank B; Dispersant Volume 200 ml; Dispersant Volume per Step 10 ml; Dilution Point 10%; Rinse Circulation Time 10 seconds; Rinse Repeat Times 1; Rinsing Volume 100 ml; Relative Refractive Index; Good Range Lower Limit 88%; and Good Range Upper Limit 92%.

Drain the cell of the instrument and add 150 mL of the dispersant to the cell and circulate, sonicate for 2 minutes and agitate. If the cell looks clean and the background reading looks flat, run a blank by pressing "Blank". Add the solid additive sample to be tested to the cell while the dispersant is agitating and circulating. Continue to add the solid additive sample slowly until the % T of the laser is 90+/−2 (around 1 mL). Allow the sample to circulate through the cell for 2 minutes. After the sample has circulated for 2 minutes, press "Measure" to analyze the sample. Once the sample is analyzed, print the graph and table. Press "Drain" to drain the cell. Rinse the system three times with deionized water using agitation and sonication for 30 seconds each time. For subsequent samples, repeat steps 2–10. The laser alignment (four triangles) should be checked between samples. The results are reported as follows: 1) a standard resolution histogram for a unimodal distribution or a sharp resolution histogram for a multi-modal distribution; and 2) the Average Particle Size (Mean Diameter).

All documents cited in the Detailed Description of the Invention are, in relevant part, incorporated herein by reference; the citation of any document is not to be considered as an admission that it is prior art with respect to the present invention. Terms or phrases defined herein are controlling even if such terms or phrases are defined differently in the incorporated herein by reference documents.

While particular examples of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A finished fibrous structure comprising a solid additive comprising a nanoparticle additive wherein the solid additive is present on a surface of the finished fibrous structure at a greater level by weight than within the finished fibrous structure and wherein the finished fibrous structure exhibits a stretch at peak load of at least about 10%.

2. The finished fibrous structure according to claim 1 wherein the solid additive is directly bound to a fiber of the finished fibrous structure.

3. The finished fibrous structure according to claim 1 wherein the finished fibrous structure exhibits a density of less than about 0.10 g/cm $^3$.

4. The finished fibrous structure according to claim 1 wherein the finished fibrous structure exhibits a stretch at peak load of at least about 15%.

5. The finished fibrous structure according to claim 1 wherein the solid additive is selected from the group consisting of: fillers, inks, dyes, medicines, opacifiers, abrasives, adhesives, wet strength aids, dry strength aids, odor control aids, absorbency aids, lotions, softeners, low surface energy particles, surface friction modifying agents, antivirucidal agents, perfume agents, skin care agents, carbohydrate polymers, cellulose, cellulose derivatives, guar, xanthan, arabinogalactan, carrageen, chitin, chitin derivatives, chitosan, chitosan derivatives, antibacterial agents, hydrophobic polymers and mixtures thereof.

6. The finished fibrous structure according to claim 1 wherein the solid additive is hygro-activated and/or thermally-activated.

7. The finished fibrous structure according to claim 1 wherein the solid additive exhibits an average particle size of less than about 900 nm.

8. The finished fibrous structure according to claim 1 wherein the finished fibrous structure further comprises a fluidizing agent, wherein the fluidizing agent exhibits a density that is greater than the density of the solid additive excluding the fluidizing agent.

9. The finished fibrous structure according to claim 1 wherein the finished fibrous structure further comprises a fluidizing agent, wherein the fluidizing agent exhibits an average particle size that is less than the average particle size of the solid additive excluding the fluidizing agent.

10. The finished fibrous structure according to claim 1 wherein the finished fibrous structure further comprises a fluidizing agent, wherein the fluidizing agent exhibits a sphericity less than the sphericity of the solid additive excluding the fluidizing agent.

11. The finished fibrous structure according to claim 1 wherein the finished fibrous structure is a layered finished fibrous structure.

12. A single- or multi-ply sanitary tissue product comprising a finished fibrous structure according to claim 1.

13. A finished fibrous structure comprising a solid additive comprising a nanoparticle additive wherein the solid additive is present on a surface of the finished fibrous structure at a greater level by weight than within the finished fibrous structure and wherein the finished fibrous structure exhibits a density of less than about 0.10 g/cm$^3$.

14. The finished fibrous structure according to claim 13 wherein the solid additive is directly bound to a fiber of the finished fibrous structure.

15. The finished fibrous structure according to claim 13 wherein the solid additive is selected from the group consisting of: fillers, inks, dyes, medicines, opacifiers, abrasives, adhesives, wet strength aids, dry strength aids, odor control aids, absorbency aids, lotions, softeners, low surface energy particles, surface friction modifying agents, antivirucidal agents, perfume agents, skin care agents, carbohydrate polymers, cellulose, cellulose derivatives, guar, xanthan, arabinogalactan, carrageen, chitin, chitin derivatives, chitosan, chitosan derivatives, antibacterial agents, hydrophobic polymers and mixtures thereof.

16. The finished fibrous structure according to claim 13 wherein the solid additive is hygro-activated and/or thermally-activated.

17. The finished fibrous structure according to claim 13 wherein the solid additive exhibits an average particle size of less than about 900 nm.

18. The finished fibrous structure according to claim 13 wherein the finished fibrous structure further comprises a fluidizing agent, wherein the fluidizing agent exhibits a density that is greater than the density of the solid additive excluding the fluidizing agent.

19. The finished fibrous structure according to claim 13 wherein the finished fibrous structure is a layered finished fibrous structure.

20. A single- or multi-ply sanitary tissue product comprising a finished fibrous structure according to claim 13.

* * * * *